US007632090B2

(12) United States Patent
Li et al.

(10) Patent No.: US 7,632,090 B2
(45) Date of Patent: Dec. 15, 2009

(54) BURNER SYSTEM AND METHOD OF OPERATING A BURNER FOR REDUCED NOX EMISSIONS

(75) Inventors: Xianming Jimmy Li, Orefield, PA (US); Aleksandar Georgi Slavejkov, Allentown, PA (US); Reed Jacob Hendershot, Breinigsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 36 days.

(21) Appl. No.: 11/928,325

(22) Filed: Oct. 30, 2007

(65) Prior Publication Data

US 2009/0111064 A1 Apr. 30, 2009

(51) Int. Cl.
*F23D 14/58* (2006.01)
*F23D 14/00* (2006.01)

(52) U.S. Cl. ..... 431/10; 431/6; 431/61; 431/187

(58) Field of Classification Search ..... 431/6, 431/10, 187, 62, 63
See application file for complete search history.

(56) References Cited

U.S. PATENT DOCUMENTS 5,257,927 A 11/1993 Lang
5,570,679 A 11/1996 Wunning
6,089,170 A 7/2000 Conti et al.
6,171,544 B1 * 1/2001 Anderson et al. ..... 266/47
6,565,361 B2 5/2003 Jones et al.
6,752,620 B2 6/2004 Heier et al.
6,773,256 B2 8/2004 Joshi et al.
6,866,503 B2 3/2005 Ladharam
7,007,661 B2 3/2006 Warlick
7,303,388 B2 * 12/2007 Joshi et al. ..... 431/10
2004/0131986 A1 * 7/2004 Stalder et al. ..... 431/278
2004/0219079 A1 11/2004 Hagen et al.
2006/0000395 A1 * 1/2006 Joshi et al. ..... 110/267
2006/0183068 A1 8/2006 Wrona et al.

FOREIGN PATENT DOCUMENTS

EP 1426681 B1 8/2005

* cited by examiner

*Primary Examiner*—Steven B McAllister
*Assistant Examiner*—Nikhil Mashruwala
(74) *Attorney, Agent, or Firm*—Bryan C. Hoke, Jr.

(57) ABSTRACT

A burner system and method of operating a burner for reduced NOx emissions. The burner system comprises a flame stabilizer, at least one fuel staging lance, an actuated valve, a temperature sensor and a controller. The amount of fuel to the flame stabilizer relative to the amount of fuel to the fuel staging lances is controlled depending on furnace temperature and/or furnace production rate.

15 Claims, 2 Drawing Sheets

BURNER SYSTEM AND METHOD OF OPERATING A BURNER FOR REDUCED NOX EMISSIONS

BACKGROUND

The present invention is directed to a gaseous fuel burner system and method for process heating. More particularly, the present invention is directed to a burner system and method of operating the burner for reducing nitrogen oxides (NOx) emissions.

Energy intensive industries are facing increased challenges in meeting NOx emissions compliance. Natural gas is commonly used as a fuel due to its clean combustion and low overall emissions. Industrial burner manufacturers have improved burner equipment design to produce very low NOx emissions and call them by the generic name of "Low NOx Burners" (LNBs) or various trade names. LNBs are used in various industries including public utilities, incineration, refineries, chemical process, power generation, paper, food, rubber, etc.

Nitrogen oxides are among the primary air pollutants emitted from combustion processes. NOx emissions have been identified as contributing to the degradation of the environment, particularly degradation of air quality, formation of smog (poor visibility) and acid rain. As a result, air quality standards are being imposed by various governmental agencies, which limit the amount of NOx gases that may be emitted into the atmosphere.

Some low NOx burners used in these industries utilize fuel staging as a means to reduce NOx. By gradually adding fuel to the flame, the flame temperature may be kept lower, thereby limiting NOx formation. Many of these low NOx burners that have fuel staging lances also have a flame stabilizer. The flame stabilizer ensures that the main flame does not extinguish. The introduction of fuel and oxidant into a furnace without stable combustion can lead to serious safety issues.

Such burners with flame stabilizers and fuel staging lances have been designed to provide a fixed proportion of fuel to the flame stabilizer and fuel staging lances via suitable orifices. The orifices are sized to provide a proportional amount of fuel suitable over the range of use, including startup and production rate changes. The relative fuel split between the flame stabilizer and the fuel staging lances in the prior art burners is fixed.

BRIEF SUMMARY

The present invention relates to a burner system and a method of operating a burner for reduced NOx emissions.

Inventors have identified that a disproportional amount of NOx is generated at the flame stabilizer relative to the fuel staging lances compared to it fraction of the total firing rate for the burner and that by changing the amount of fuel to the flame stabilizer, NOx emissions can be reduced while still maintaining flame stability. The fixed proportion of fuel to the flame stabilizer versus the fuel staging lances was found detrimental to the reduction of NOx emissions.

The burner system comprises a flame stabilizer; an oxidant gas feed duct for introducing an oxidant gas into a furnace through or around the flame stabilizer; a flame stabilizer fuel feed duct for introducing a first fuel into the furnace through or around the flame stabilizer; at least one fuel staging lance for introducing the first fuel into the furnace; an actuated valve for adjusting a flow rate of the first fuel through the flame stabilizer fuel feed duct, the actuated valve upstream of the flame stabilizer and not upstream of the at least one fuel staging lance; a temperature sensor for monitoring a furnace temperature; and a controller in signal communication with the temperature sensor and signal communication with the actuated valve, the controller for receiving a first signal corresponding to the furnace temperature and for sending a second signal for adjusting the actuated valve.

The burner system may further comprise a fuel start-up lance for introducing the first fuel into the furnace. The burner system may further comprise at least one valve for alternately directing the first fuel to the fuel start-up lance or the at least one fuel staging lance.

The flame stabilizer may be a fluid-based flame stabilizer. The flame stabilizer may be a flame holder. The flame stabilizer may be a swirler.

The burner system may also include a flame detector to view the flame at the flame stabilizer.

The method of operating a burner, the burner having at least one fuel staging lance and a flame stabilizer, comprises monitoring a furnace temperature; introducing an oxidant gas into a furnace through or around the flame stabilizer; introducing a first volume of a first fuel, $V_1$, into the furnace through or around the flame stabilizer during a first time period when the furnace temperature is less than a predetermined temperature; introducing a second volume of the first fuel, $V_2$, into the furnace through at least one of a fuel start-up lance and the at least one fuel staging lance during the first time period; introducing the first fuel into the furnace through or around the flame stabilizer at a first flow rate of the first fuel, $F_1$, during a second time period when at a first furnace production rate, $R_1$, and responsive to the furnace temperature exceeding the predetermined temperature; and introducing the first fuel through the at least one fuel staging lance at a second flow rate of the first fuel, $F_2$, during the second time period;

$$\text{wherein } 0 < \frac{F_1}{F_2} < \frac{V_1}{V_2} \text{ or } 0 < \frac{F_1}{F_2} < 0.9 \times \frac{V_1}{V_2} \text{ or } 0 < \frac{F_1}{F_2} < 0.75 \times \frac{V_1}{V_2}.$$

The predetermined temperature may be at or above an autoignition temperature for a mixture of the first fuel and the oxidant gas.

The method may further comprise blending a second fuel with the first fuel prior to introducing the first fuel into the furnace through the at least one fuel staging lance during the first time period; and blending the second fuel with the first fuel prior to introducing the first fuel into the furnace through the at least one fuel staging lance during the second time period. The predetermined temperature may be at or above an autoignition temperature for a mixture of the first fuel, the second fuel and the oxidant gas.

The higher heating value of the second fuel may be less than the higher heating value of the first fuel.

The furnace temperature may be a furnace wall temperature. The furnace temperature may be a furnace exhaust gas temperature. The furnace temperature may be an average furnace temperature determined by averaging two or more temperature sensor readings from temperature sensors place around the furnace.

The method may further comprise introducing the first fuel into the furnace through or around the flame stabilizer at a third flow rate, $F_3$, during a third time period when at a second furnace production rate, $R_2$; and introducing the first fuel into the furnace through the at least one fuel staging lance at a fourth flow rate $F_4$ during the third time period; wherein $R_1 < R_2$ and $$0 < \frac{F_3}{F_4} < \frac{F_1}{F_2} \text{ or } 0 < \frac{F_3}{F_4} < 0.9 \times \frac{F_1}{F_2} \text{ or } 0 < \frac{F_3}{F_4} < 0.75 \times \frac{F_1}{F_2}.$$

In another embodiment the method for operating a burner having a flame stabilizer and at least one fuel staging lance comprises introducing an oxidant gas into a furnace through or around the flame stabilizer; introducing a first fuel into the furnace through or around the flame stabilizer at a first flow rate, $G_1$, during a first duration when at a first furnace production rate, $R_1$; introducing the first fuel into the furnace through the at least one fuel staging lance at a second flow rate, $G_2$, during the first duration; introducing the first fuel into the furnace through or around the flame stabilizer at a third flow rate, $G_3$, during a second duration when at a second furnace production rate, $R_2$; introducing the first fuel into the furnace through the at least one fuel staging lance at a fourth flow rate $G_4$ during the second duration; wherein $R_1 < R_2$ and $$0 < \frac{G_3}{G_4} < \frac{G_1}{G_2} 0 \text{ or } 0 < \frac{G_3}{G_4} < 0.9 \times \frac{G_1}{G_2} \text{ or } 0 < \frac{G_3}{G_4} < 0.75 \times \frac{G_1}{G_2}.$$

DETAILED DESCRIPTION

The indefinite articles "a" and "an" as used herein mean one or more when applied to any feature in embodiments of the present invention described in the specification and claims. The use of "a" and "an" does not limit the meaning to a single feature unless such a limit is specifically stated. The definite article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

For the purposes of simplicity and clarity, detailed descriptions of well-known devices, circuits, and methods are omitted so as not to obscure the description of the present invention with unnecessary detail.

The present invention relates to a burner and a method of operating the burner for reduced NOx emissions.

Figure 1:
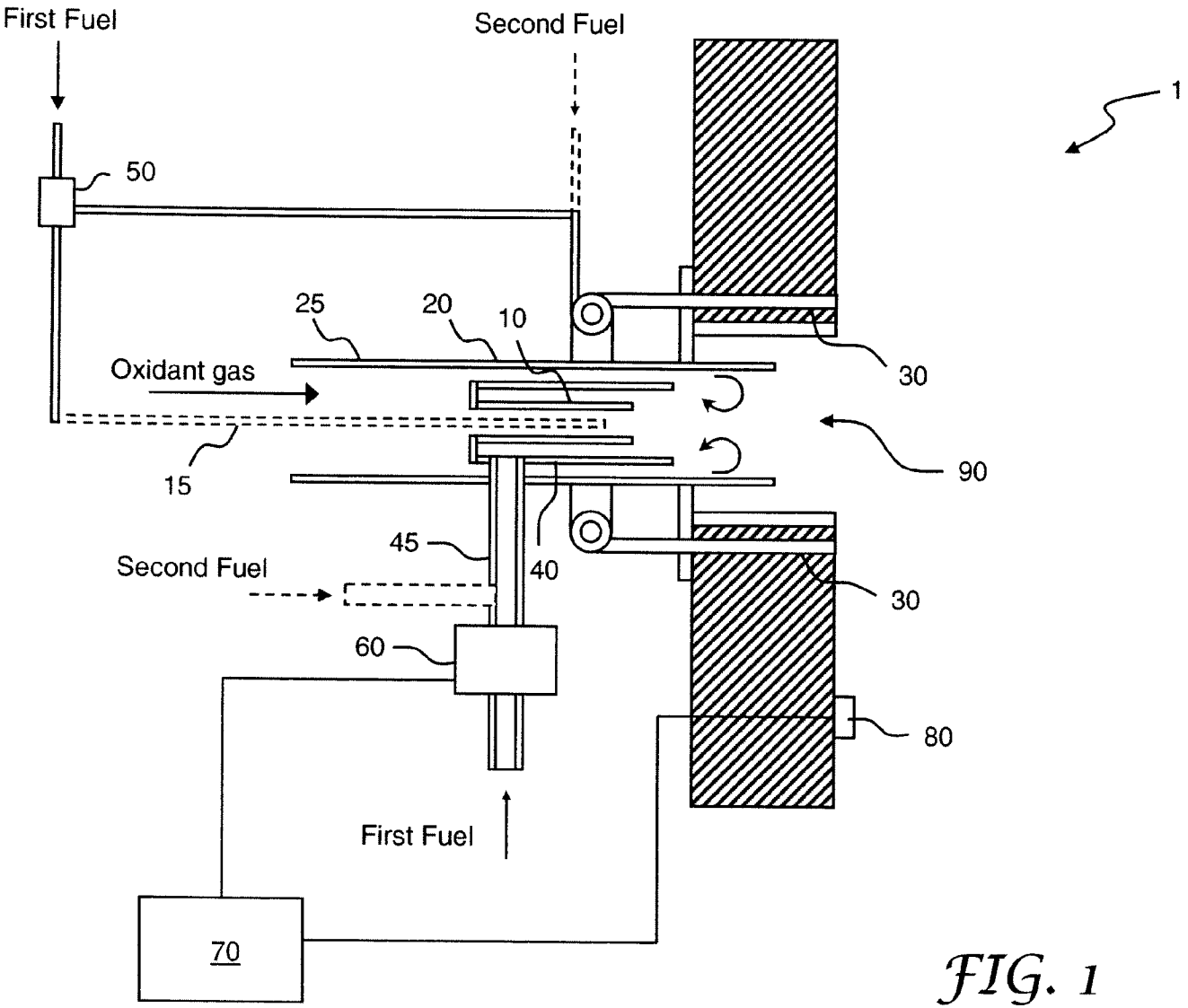
FIG. 1 illustrates a burner system having a flame stabilizer and at least one fuel staging lance.

Referring to FIG. 1, the burner system 1 comprises a flame stabilizer 90. A flame stabilizer forms an eddy that anchors a flame. A flame stabilizer may be selected from at least one of a flame holder, a swirler and a fluid-based flame stabilizer. A flame stabilizer may include features from one or more of a conventional flame holder, a conventional swirler, and a fluid-based flame stabilizer.

The flame stabilizer may be a so-called flame holder known in the art where an eddy is formed in the wake of a bluff body. The flame holder may be located in the center of the oxidant gas or combustion air stream. The flame holder may have holes in it where the fuel and/or oxidant gas flow through the flame holder. The flame holder may be constructed without holes in it so that the fuel and/or oxidant gas flows around the flame holder.

The flame stabilizer may be a conventional swirler known in the combustion art. U.S. Pat. No. 6,089,170A discloses a swirler used as a flame stabilizer.

The flame stabilizer may be a fluid-based flame stabilizer as described in U.S. Pat. No. 6,773,256. A fluid-based flame stabilizer is any device wherein one or more fluids are introduced into a duct through at least two nozzles at different fluid velocities and a stream-wise vortex (eddy) is formed within the pipe due to the differences in the fluid velocities. A fluid-based flame stabilizer is also referred to as a Large Scale Vortex (LSV) device.

The flame stabilizer 90 shown in FIG. 1 is a fluid-based flame stabilizer. The fluid-based flame stabilizer comprises an inner oxidant gas duct 10 recessed inside a fuel duct 40, which is further recessed inside an outer oxidant gas duct 20.

As used herein, a duct is any pipe, tube, conduit or channel that conveys a substance. A duct may have an annular cross-section.

The burner further comprises an oxidant gas feed duct 25 for introducing an oxidant gas into a furnace through or around the flame stabilizer. The oxidant gas feed duct 25 feeds both the outer oxidant gas duct 20 and the inner oxidant gas duct 10.

Oxidant gas is passed through the annular passage defined between the outer oxidant gas duct 20 and fuel duct 40. Oxidant gas is also passed through the inner oxidant gas duct 10. The oxidant gas passed through these two passages may be the same or different. The velocity of the oxidant gas passed through the outer annular passage is greater than the velocity of the oxidant gas passed through the inner oxidant gas duct 10 which in turn is greater than the velocity of the fuel in fuel duct 40. Due to the mismatch in velocity between the oxidant and the fuel, a pressure imbalance is developed. This causes a streamwise vortex to develop downstream in the outer oxidant duct 20. This streamwise vortex acts to stabilize the flame.

Although the burner system is described with a fluid-based flame stabilizer, a flame holder (not shown) or a swirler (not shown) could be used. One skilled in the art could easily exchange a flame holder and/or swirler for the fluid-based flame stabilizer shown in FIG. 1 without undue experimentation.

Referring to FIG. 1, the burner system 1 also comprises a flame stabilizer fuel feed duct 45 for introducing a first fuel into the furnace through or around the flame stabilizer. The flame stabilizer fuel feed duct 45 is in fluid communication with the fuel duct 40 of the flame stabilizer.

As shown in FIG. 1, the burner system also comprises at least one fuel staging lance 30 for introducing the first fuel into the furnace. FIG. 1 shows two fuel staging lances 30, however, any number of fuel staging lances may be used as desired. A fuel staging lance is defined as any duct for introducing fuel into a furnace downstream of a flame stabilizer and at a distance away from any oxidant nozzle. A fuel staging lance adds fuel to a flame downstream of the base of the flame. The purpose of a fuel staging lance is to gradually add fuel to the flame in a staged manner. Thus the term "fuel staging lance." As shown in FIG. 1, the fuel staging lances 30 are positioned in the furnace wall outside of the oxidant stream and will thereby introduce the fuel downstream of the base of the flame. By contrast, a fuel port introduces fuel directly into an oxidant stream.

As shown in FIG. 1, the burner system may optionally comprise a fuel start-up lance 15 for introducing the first fuel into the furnace. A valve 50 may be used to alternately direct the first fuel to the fuel start-up lance or the at least one fuel staging lance 30.

One or more valves (not shown) may be used to regulate the flow rate of the first fuel to the fuel staging lances 30. Alternatively, a fixed orifice may be used to regulate the flow of the first fuel to the fuel staging lances 30.

Fuel staging lances 30 may be used to introduce a mixture of the first fuel and a second fuel. Alternatively, fuel staging lances 30 may be used to introduce only the first fuel and secondary fuel staging lances (not shown) may be used to introduce only the second fuel. In the alternative case, fuel staging lances 30 introduce the first fuel and secondary fuel staging lances (not shown) introduce the second fuel.

As shown in FIG. 1, the burner system 1 also comprises an actuated valve 60 for adjusting a flow rate of the first fuel through the flame stabilizer fuel duct 45. The actuated valve 60 is located upstream of the flame stabilizer 90 but is not upstream of the at least one fuel staging lance 30. In this way the first fuel to the flame stabilizer 90 may be independently controlled from the first fuel to the at least one fuel staging lance 30.

The burner system 1 also comprises a temperature sensor 80 for monitoring a furnace temperature. The furnace temperature may be a furnace wall temperature as depicted in FIG. 1. The furnace temperature may be a furnace exhaust gas temperature or other suitable temperature. The temperature sensor may be a thermocouple, optical pyrometer, suction pyrometer or any other device known in the art for measuring temperature.

The burner system 1 also comprises a controller 70 in signal communication with the temperature sensor 80 and signal communication with the actuated valve 60. The controller may be a programmable logic controller (PLC), computer or the like. The controller receives a first signal from the temperature sensor 80 corresponding to the furnace temperature and sends a second signal for adjusting the actuated valve 60. Signal communication may be wireless and/or hardwired.

Although described with reference to a single burner, fuel headers may be used and valves may be used to control the flow through the fuel headers. For example, valve 50 may be used to control the flow of the first fuel to a plurality of fuel start-up lances to a plurality of burners. Valve 50 may be used to direct flow to a plurality of at least one fuel staging lances of a plurality of burners. Actuated valve 60 may be used to control the flow rate to a header connected to a plurality of flame stabilizer fuel ducts thereby adjusting the flow rate to the plurality of flame stabilizer fuel ducts.

The present invention relates to a method of operating a burner where the burner has at least one fuel staging lance and a flame stabilizer. The method will be described in relation to FIG. 1.

The method comprises monitoring a furnace temperature. Monitoring is accomplished by repeated measuring of the furnace temperature. The furnace temperature may be a wall temperature, a furnace gas exhaust temperature, flame temperature or other suitable temperature related to the furnace. As described above, various sensors may be used to measure furnace temperature. As depicted in FIG. 1, the furnace temperature is measured by temperature sensor 80.

The method also comprises introducing an oxidant gas into the furnace through or around the flame stabilizer 90. As shown in FIG. 1, oxidant gas flows through the flame stabilizer 90 through outer oxidant gas duct 20 and through inner oxidant gas duct 10.

As used herein, an oxidant gas is any oxygen-containing gas. The oxidant gas may be air. The oxidant gas may be oxygen-enriched air having an oxygen concentration greater than air up to 30 volume % oxygen. The oxidant gas may be oxygen-depleted air having an oxygen concentration less than air down to 15 volume % oxygen. The oxidant gas may be industrial oxygen having a concentration of 85 volume % to 100 volume %. The oxidant gas may be preheated.

The method further comprises introducing a first volume of a first fuel, $V_1$, into the furnace through or around the flame stabilizer 90 during a first time period when the furnace temperature is less than a predetermined temperature. Volume is calculated in the conventional way by integrating the flow rate as a function of time over the desired time period, here the first time period.

The first time period may be at least a portion of the start up time when the furnace temperature is less than the predetermined temperature. The first time period may be any selected length of time. The flow rate during the first time period may be constant or variable.

The predetermined temperature may be any selected temperature. The predetermined temperature may be at or above an autoignition temperature for a mixture of the first fuel and the oxidant gas at the burner. The predetermined temperature may be selected above the autoignition temperature of the fuel and oxidant to provide a suitable margin of safety.

The flow rate through or around the flame stabilizer may vary when the furnace temperature is less than the predetermined temperature. The flow rate through or around the flame stabilizer may be constant during at least portion of the time when the furnace temperature is less than the predetermined temperature.

The first fuel may contain one or more of natural gas, refinery off-gas, pressure swing adsorber purge gas, refinery fuel gas or other suitable fuel. The first fuel may be a mixture of fuels from various fuel sources.

The method further comprises introducing a second volume of the first fuel, $V_2$, into the furnace through at least one of a fuel start-up lance 15 and the at least one fuel staging lance 30 during the first time period. The volume, $V_2$, corresponds to the total volume through all of the at least one fuel staging lances 30. During the same first time period, a first volume of fuel, $V_1$, is introduced through or around the flame stabilizer 90 and a second volume of the first fuel, $V_2$, is introduced through the at least one fuel staging lance 30. In case the first fuel is mixed with a second fuel, the second volume of the first fuel, $V_2$, is the volume of the first fuel, not including the volume of the second fuel.

During the first time period, the first fuel may be initially directed through a start-up lance 15. Later during the first time period, the first fuel may be directed through that at least one fuel staging lance 30. Valve 50 may be used to direct the first fuel through either or both of the start-up lance 15 and the at least one fuel staging lance 30.

Alternatively, the first fuel may be directed through the start-up lance 15 during all of the first time period.

In another alternative, the second volume of the first fuel, $V_2$, may be directed through both the start-up lance 15 and the at least one fuel staging lance 30.

The higher heating value of the second fuel may be less than the higher heating value of the first fuel. The second fuel may be a low value fuel, for example pressure swing adsorber purge gas, and the first fuel may be a so-called trim fuel, which may be natural gas.

The method further comprises introducing the first fuel into the furnace through or around the flame stabilizer 90 at a first flow rate of the first fuel, $F_1$, during a second time period. During the second time period, the furnace is at a first furnace production rate, $R_1$, and the furnace temperature is greater than the predetermined temperature.

The furnace production rate is the rate of production of a product produced by the furnace, for example the hydrogen production rate for a reformer or steam production rate for a boiler.

The method further comprises introducing the first fuel through the at least one fuel staging lance 30 at a second flow rate of the first fuel, $F_2$, during the second time period.

According to the method, $$0 < \frac{F_1}{F_2} < \frac{V_1}{V_2}.$$

This means that the ratio of the flow rate of the first fuel through or around the flame stabilizer to the flow rate of the first fuel through the at least one fuel staging lance during the second time period is less than the ratio of the time-averaged flow rate of the first fuel through or around the flame stabilizer to the time-averaged flow rate of the first fuel through the at least one fuel staging lance during the first time period. The time-averaged flow rate is the total volume that passed during the time period divided by the value of the time period. Above the predetermined temperature, the ratio of first fuel directed to the fuel stabilizer to the first fuel directed to the at least one fuel staging lance is decreased. The inventors found that by decreasing the relative amount of the first fuel to the flame stabilizer, NOx emissions were reduced. Inventors also discovered that above the predetermined temperature e.g. the autoignition temperature, the higher flow rate of first fuel to the flame stabilizer was not needed.

The ratio $$\frac{F_1}{F_2}$$

may be decreased to varying degrees, for example, $$0 < \frac{F_1}{F_2} < 0.9 \times \frac{V_1}{V_2} \text{ or } 0 < \frac{F_1}{F_2} < 0.75 \times \frac{V_1}{V_2}.$$

The ratio may be decreased according to the stability of the flame, which can depend on the flame stabilizer and can be determined without undue experimentation.

The method may further comprise blending a second fuel with the first fuel prior to introducing the first fuel into the furnace through the at least one fuel staging lance 30 during the first time period, and blending the second fuel with the first fuel prior to introducing the first fuel into the furnace through the at least one fuel staging lance 30 during the second time period. As depicted in FIG. 1, an optional second fuel may be blended with the first fuel prior to introducing the resulting mixture through the at least one fuel staging lance 30.

In case a second fuel is used, the predetermined temperature may be at or above an autoignition temperature for a mixture of the first fuel, the second fuel and the oxidant gas.

The method may also be used for production rate changes. The method may further comprise introducing the first fuel into the furnace through or around the flame stabilizer 90 at a third flow rate, $F_3$, and introducing the first fuel into the furnace through the at least one fuel staging lance 30 at a fourth flow rate, $F_4$, during a third time period. During the third time period, the furnace is at a second furnace production rate, $R_2$, and the furnace temperature is greater than the predetermined temperature.

According to the method $$0 < \frac{F_3}{F_4} < \frac{F_1}{F_2} \text{ and } R_{1-} < R_{2-}$$

As the production rate of the furnace is increased the relative amount of the first fuel to the flame stabilizer 90 is decreased, thereby providing a sufficient amount of the first fuel for flame stabilizing, while limiting the NOx emissions.

The ratio $$\frac{F_3}{F_4}$$

may be decreased to varying degrees, for example, $$0 < \frac{F_3}{F_4} < 0.9 \times \frac{F_1}{F_2} \text{ or } 0 < \frac{F_3}{F_4} < 0.75 \times \frac{F_1}{F_2}.$$

The ratio may be decreased according to the stability of the flame, which can depend on the flame stabilizer and can be determined without undue experimentation. The flow rates to the flame stabilizer may be the same for the two production rates, while the flow rate to the at least one fuel staging lance 30 may be increased for the higher production rate.

Another embodiment of the method will be described with reference to FIG. 1. In this embodiment, the method of operating the burner comprises introducing an oxidant gas into a furnace through or around the flame stabilizer 90. The method according to this embodiment further comprises introducing a first fuel into the furnace through or around the flame stabilizer 90 at a first flow rate, $G_1$, when at a first furnace production rate, $R_1$, and introducing the first fuel into the furnace through the at least one fuel staging lance 30 at a second flow rate, $G_2$, during a first duration. The method according to this embodiment further comprises introducing the first fuel into the furnace through or around the flame stabilizer 90 at a third flow rate, $G_3$, during a second duration when at a second furnace production rate, $R_2$, and introducing the first fuel into the furnace through the at least one fuel staging lance 30 at a fourth flow rate $G_4$ during a second duration.

According to this embodiment of the method $$0 < \frac{G_3}{G_4} < \frac{G_1}{G_2}$$

and $R_1 < R_2$.

The ratio $$\frac{G_3}{G_4}$$

may be decreased to varying degrees, for example, $$0 < \frac{G_3}{G_4} < 0.9 \times \frac{G_1}{G_2} \text{ or } 0 < \frac{G_3}{G_4} < 0.75 \times \frac{G_1}{G_2}.$$

The ratio may be decreased according to the stability of the flame, which can depend on the flame stabilizer and can be determined without undue experimentation.

EXAMPLE

Experiments were conducted to show the effect of the ratio of fuel to the flame stabilizer to the fuel to the staging lances. The burner included a fluid based flame stabilizer as shown schematically in FIG. 1. The fuel to the burner was natural gas.

Figure 2:
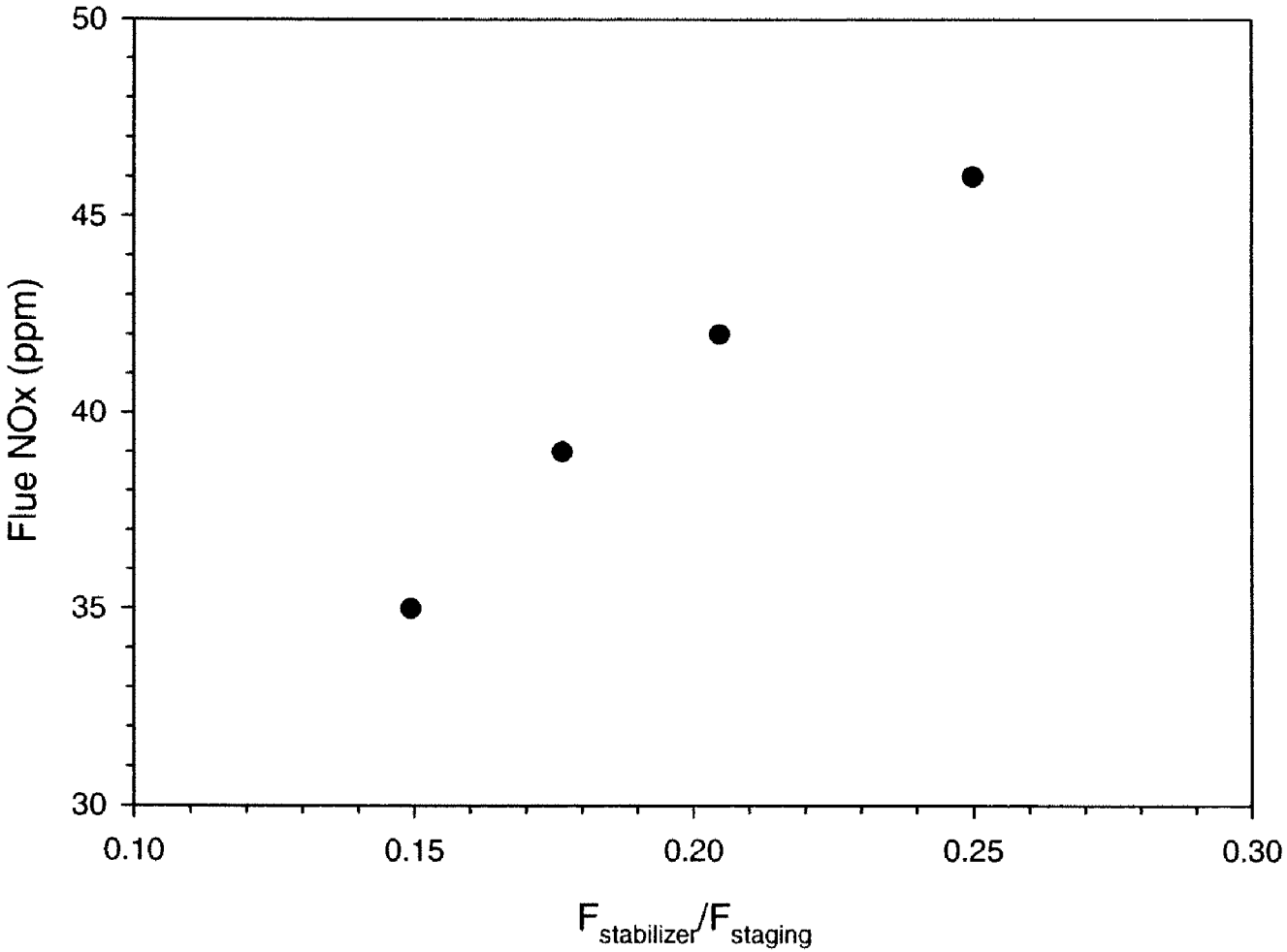
FIG. 2 is a plot of NOx concentration emissions versus the ratio of fuel to the fuel stabilizer to the fuel to the fuel staging lances.

FIG. 2 is a plot of NOx emissions as a function of the ratio of fuel to the flame stabilizer to the fuel to the fuel staging lances. The total firing rate was about 1.4 MW for each of the experiments. Separate headers were used to supply fuel to the flame stabilizer and the fuel to the staging lances. A valve was use to change the fuel ratio to the flame stabilizer and the fuel staging lances. The percent excess oxygen was maintained about constant at 2 volume % excess oxygen.

A stable flame was observed for each of the experiments. The data clearly shows that as the amount of fuel to the flame stabilizer is decreased, the NOx concentration in the flue gas is decreased.

We claim:

1. A method of operating a burner, the burner having at least one fuel staging lance and a flame stabilizer, the method comprising:

monitoring a furnace temperature;

introducing an oxidant gas into a furnace through or around the flame stabilizer;

introducing a first volume of a first fuel, $V_1$, into the furnace through or around the flame stabilizer during a first time period when the furnace temperature is less than a predetermined temperature;

introducing a second volume of the first fuel, $V_2$, into the furnace through at least one of a fuel start-up lance and the at least one fuel staging lance during the first time period;

introducing the first fuel into the furnace through or around the flame stabilizer at a first flow rate of the first fuel, $F_1$, during a second time period when at a first furnace production rate, $R_1$, and responsive to the furnace temperature exceeding the predetermined temperature; and introducing the first fuel through the at least one fuel staging lance at a second flow rate of the first fuel, $F_2$, during the second time period;

$$\text{wherein } 0 < \frac{F_1}{F_2} < \frac{V_1}{V_2}.$$

2. The method of claim 1 wherein the predetermined temperature is at or above an autoignition temperature for a mixture of the first fuel and the oxidant gas.

3. The method of claim 1 further comprising:

blending a second fuel with the first fuel prior to introducing the first fuel into the furnace through the at least one fuel staging lance during the first time period; and blending the second fuel with the first fuel prior to introducing the first fuel into the furnace through the at least one fuel staging lance during the second time period.

4. The method of claim 3 wherein the predetermined temperature is at or above an autoignition temperature for a mixture of the first fuel, the second fuel and the oxidant gas.

5. The method of claim 3 wherein the second fuel has a higher heating value that is less than a higher heating value of the first fuel.

6. The method of claim 1

$$\text{wherein } 0 < \frac{F_1}{F_2} < 0.9 \times \frac{V_1}{V_2}.$$

7. The method of claim 1

$$\text{wherein } 0 < \frac{F_1}{F_2} < 0.75 \times \frac{V_1}{V_2}.$$

8. The method of claim 1 wherein the furnace temperature is a furnace wall temperature.

9. The method of claim 1 wherein the furnace temperature is a furnace exhaust gas temperature.

10. The method of claim 1 further comprising:

introducing the first fuel into the furnace through or around the flame stabilizer at a third flow rate, $F_3$, during a third time period when at a second furnace production rate, $R_2$; and introducing the first fuel into the furnace through the at least one fuel staging lance at a fourth flow rate $F_4$ during the third time period;

$$\text{wherein } 0 < \frac{F_3}{F_4} < \frac{F_1}{F_2}$$

and $R_1 < R_2$.

11. The method of claim 10

$$\text{wherein } 0 < \frac{F_3}{F_4} < 0.9 \times \frac{F_1}{F_2}.$$

12. The method of claim 10

$$\text{wherein } 0 < \frac{F_3}{F_4} < 0.75 \times \frac{F_1}{F_2}.$$

13. A method of operating a burner, the burner having at least one fuel staging lance and a flame stabilizer, the method comprising:

introducing an oxidant gas into a furnace through or around the flame stabilizer;

introducing a first fuel into the furnace through or around the flame stabilizer at a first flow rate, $G_1$, during a first duration when at a first furnace production rate, $R_1$;

introducing the first fuel into the furnace through the at least one fuel staging lance at a second flow rate, $G_2$, during the first duration;

introducing the first fuel into the furnace through or around the flame stabilizer at a third flow rate, $G_3$, during a second duration when at a second furnace production rate, $R_2$;

introducing the first fuel into the furnace through the at least one fuel staging lance at a fourth flow rate $G_4$ during the second duration;

$$\text{wherein } 0 < \frac{G_3}{G_4} < \frac{G_1}{G_2}$$

and $R_1 < R_2$.

14. The method of claim 13

$$\text{wherein } 0 < \frac{G_3}{G_4} < 0.9 \times \frac{G_1}{G_2}.$$

15. The method of claim 13

$$\text{wherein } 0 < \frac{G_3}{G_4} < 0.75 \times \frac{G_1}{G_2}.$$

* * * * *